US008731436B2

(12) United States Patent
Gamzon-Kapeller et al.

(10) Patent No.: US 8,731,436 B2
(45) Date of Patent: May 20, 2014

(54) POSITIONING SYSTEM FOR A CHARGE ROLLER AND PRINTER USING THE SAME

(75) Inventors: Yonatan Gamzon-Kapeller, Misgav Dov (IL); Yonni Hartstein, Ramat Gan (IL); Shmuel I. Borenstain, Neve Daniel (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 246 days.

(21) Appl. No.: 13/150,431

(22) Filed: Jun. 1, 2011

(65) Prior Publication Data

US 2012/0308262 A1 Dec. 6, 2012

(51) Int. Cl.
*G03G 15/02* (2006.01)

(52) U.S. Cl.
USPC ..... 399/115

(58) Field of Classification Search
USPC ..... 399/115, 168, 169, 176
See application file for complete search history.

(56) References Cited

U.S. PATENT DOCUMENTS 5,697,020 A * 12/1997 Sato et al.
6,055,396 A 4/2000 Pang
6,803,162 B2 10/2004 Niimi
7,050,742 B2 5/2006 Gila et al.
7,366,447 B2 4/2008 Mukai et al.
7,756,430 B1 7/2010 Chang et al.
7,835,668 B2 11/2010 Lee et al.
2005/0095035 A1* 5/2005 Vejtasa et al. ..... 399/168
2005/0129426 A1 6/2005 Tsunemi et al.

FOREIGN PATENT DOCUMENTS

EP 1528436 4/2005

OTHER PUBLICATIONS

Omega, Introduction to Stepper Motors and Drives, http://www.omega.com/prodinfo/stepper_motors.html, 4 pages.

* cited by examiner

*Primary Examiner* — Walter L Lindsay, Jr.
*Assistant Examiner* — Milton Gonzalez

(57) ABSTRACT

A printer includes a photoconductor, a charge roller, and a positioner. The photoconductor includes an outer surface defining a seam region and a non-seam region while the charge roller is configured to rollingly engage the outer surface of the non-seam region. The positioner is operably coupled to the charge roller and includes a discrete step drive configured to maintain a minimum spacing between the charge roller and the seam region of the outer surface when the seam region passes underneath the charge roller.

9 Claims, 11 Drawing Sheets

POSITIONING SYSTEM FOR A CHARGE ROLLER AND PRINTER USING THE SAME

BACKGROUND

Many conventional electrophotograhic printers include a photoconductor drum having a seam region on its outer surface. As part of a normal printing process, cleaning oil is used to remove toner or ink from the outer surface of the photoconductor. Typically, this oil accumulates over time within the seam region.

Conventional electrophotographic printers also include a charging device, such as a charge roller for imparting a charge onto the outer surface of the photoconductor prior to the writing of an image, via an exposure device, onto the photoconductor. However, in conventional printers in which the charge roller provides the charge via rolling contact against the photoconductor, the charging roller sometimes picks up oil from the seam region because the charging roller drops too far into the seam region when the seam region passes underneath the charging roller. This oil on the charging device, in turn, sometimes results in image defects or otherwise degrades image quality. Moreover, this misplaced oil can increase the chances of arcing between the charge roller and a ground plane of the photoconductor.

While some attempts have been made to better regulate the position of a charge roller relative to a seam region of a photoconductor, conventional solutions fall short of achieving the desired positioning of a charge roller while maintaining a desired charge on the photoconductor.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present disclosure can be positioned in a number of different orientations, the directional terminology is used for purposes of illustration and is in no way limiting. It is to be understood that other embodiments may be utilized and structural or logical changes may be made without departing from the scope of the present disclosure. The following detailed description, therefore, is not to be taken in a limiting sense, and the scope of the present disclosure is defined by the appended claims.

Embodiments of the present disclosure provide a charge roller assembly having a positioner configured to prevent a charge roller from contacting a seam region of an outer surface of a photoconductor. In one aspect, accurate and precise control over the position of the charge roller relative to the seam region is achieved via a discrete step drive. In one embodiment, the drive comprises a stepper linear actuator coupled to the charge roller via a first linkage. In other embodiments, the drive comprises a stepper rotational actuator coupled to the charge roller via a second linkage including a cam and a cam follower. In addition, in another aspect, a charge roller assembly includes a voltage applicator configured to apply a higher voltage to the seam region of the photoconductor. However, because of the high resolution with which the charge roller assembly controls the position of the charge roller (relative to the seam region), this higher voltage is generally lower than would otherwise be applied in conventional systems in which less accurate control is provided for positioning a charge roller.

These embodiments, and additional embodiments, are further described below in association with FIGS. 1-13.

Figure 1:
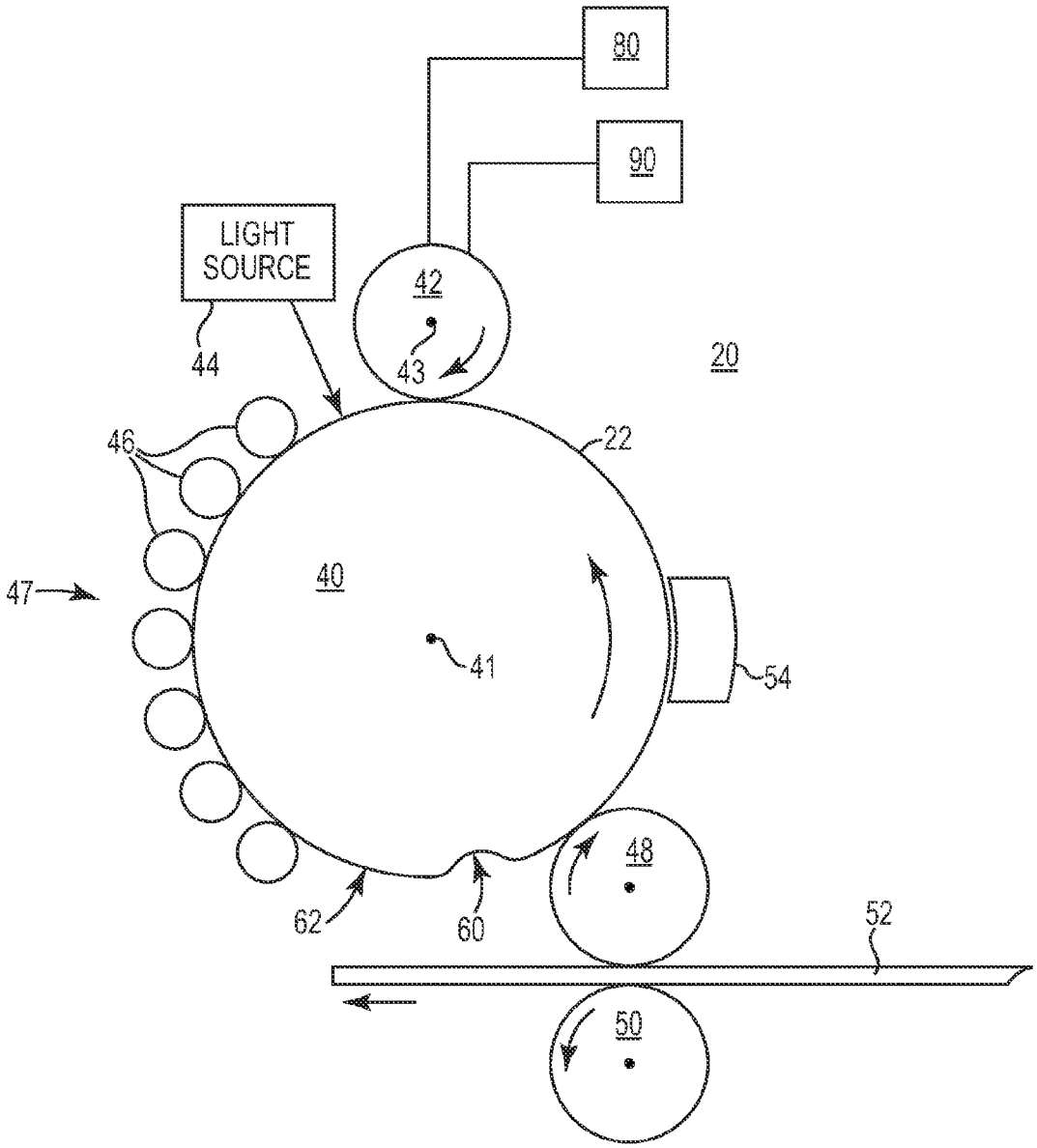
FIG. 1 is a front plan view schematically illustrating a press, according to an embodiment of the present disclosure.
Figure 3:
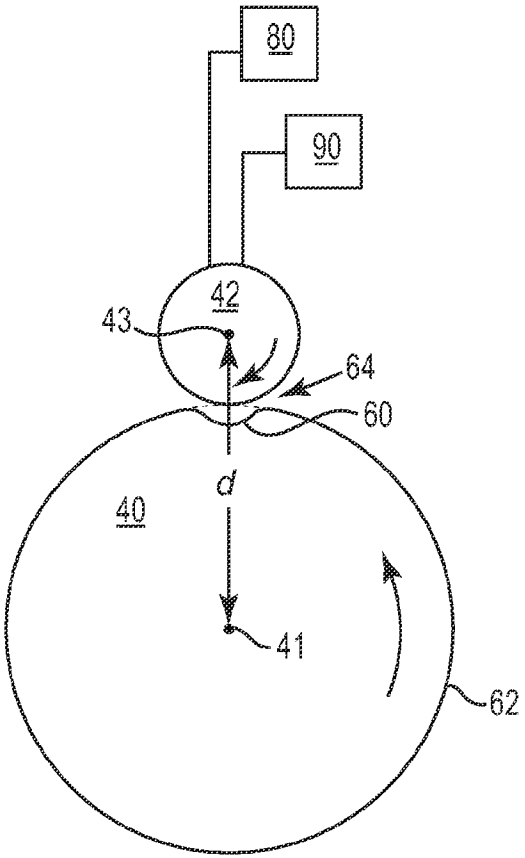
FIGS. 2-3 are front plan views that schematically illustrating a positioning system for a charge roller, according to an embodiment of the present disclosure.
Figure 2:
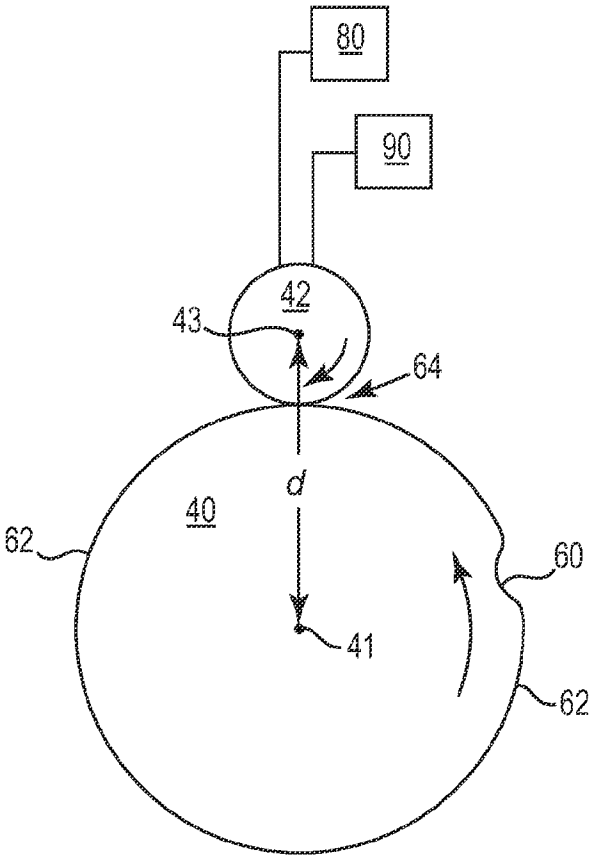

FIGS. 1-3 are front views schematically illustrating an image transfer device such as a printer press 20 configured to implement electrophotographic imaging operations, according to one embodiment of the present disclosure. In one embodiment, printer 20 includes a photoconductor 40, a charge roller 42, an exposure device (such as light source 44), a development station 47, an image transfer cylinder 48, an impression cylinder 50, a cleaning apparatus 54, a positioning control system 80, and a charging control system 90. Other configurations are possible, including more, less, or alternative components. In some embodiments, printer 20 comprises a liquid electrophotographic (LEP) printer having a photoconductor surface, while in other embodiments, principles of the present disclosure are applied to dry electrophotographic processes.

As shown in FIGS. 1-3, photoconductor 40 is embodied as a drum or cylinder having a photoconductor sheet as the outer surface 22, wherein ends of the sheet may be provided adjacent to one another at a seam region 60 (as further described and illustrated later in association with FIGS. 4-5). In one aspect, outer surface 22 is recessed (i.e. has a smaller radius) at seam region 60 compared with a radius of an imaging or non-seam region 62 of the outer surface 22. Moreover, it will be understood that the seam region 60 may be smaller or larger than shown in FIGS. 1-3. In one aspect, non-seam region 62 refers to portions of the outer surface 22 wherein images are formed and developed as described further below. In one aspect, photoconductor 40 rotates about an axis 41, wherein portions of outer surface 22 pass adjacent to charge roller 42, light source 44, development station 47, image transfer cylinder 48, and cleaning apparatus 54.

Via charging control system 90, charge roller 42 is configured to provide an electrical charge (typically −500 to −1000 V or 500 to 1000 V) to seam region 60 and non-seam region 62 of photoconductor 40. In one aspect, charge roller 42 includes a conductive support shaft (not shown) with a conductive polymer material surrounding the support shaft. In one embodiment, charge roller 42 is configured to rotate about axis 43 and contact non-seam region 62 of photoconductor 40 to provide the electrical charge to non-seam region 62, and to be spaced from seam region 60 while still providing an electrical charge to seam region 60. Charge control system 90 supplies voltage to charge roller 42 in any of various ways known in the art. The voltage may result from a DC voltage source, or a combination of DC and AC voltage sources. Charge roller 42 is biased by the voltage source to a predetermined electric potential sufficient to create the desired potential on surface 22 of photoconductor 40, for example approximately −1500 to −1000 Volts.

In one embodiment, charge roller 42 is configured to provide an electrical charge of approximately −1000 V to the non-seam region 62 of photoconductor 40. With charge roller 42 configured to rotate about axis 43, charge roller 42 rolls on outer surface 22 of photoconductor 40 to provide the electrical charge to non-seam region 62. Moreover, as further described below, charge roller 42 provides an electrical charge to outer surface 22 in seam region 60, despite charge roller 42 not being in contact with outer surface 22 in seam region 60. To do so, a higher voltage is applied from charge roller 42 as charge roller 42 passes by seam region 60.

Light source 44, such as a laser, acts an exposure device to discharge the electrical charge on the photoconductor 40 at selected locations corresponding to a desired image to be formed. The discharging of the electrical charge provides a latent image upon the non-seam region 62 of the photoconductor 40. In other embodiments, light source is replaced with other exposure devices known to those skilled in the art.

Development station 47 is configured to provide a marking agent, such as dry toner in a dry configuration or liquid ink in a liquid configuration. In some embodiments, the marking agent is electrically charged and attracted to the discharged locations of the non-seam region 62 of the photoconductor 40 corresponding to the latent image to develop the latent image. Moreover, in one embodiment, development station 47 includes a plurality of development rollers 46 (FIG. 3) which provides marking agents of different colors to develop the latent images. The marking agent of the developed image formed upon the non-seam region 62 of the photoconductor 40 is transferred to media 52 (such as paper) using a transfer cylinder 48. As shown in FIG. 1, impression cylinder 50 defines a nip with transfer cylinder 48 to transfer the developed image to paper 52.

Cleaning station 54 removes any marking agent which was not transferred from non-seam region 62 to transfer cylinder 48 prior to recharging by charge roller 42. In one embodiment, cleaning station 54 applies imaging oil to the outer surface 22 of photoconductor 40 to assist with the removal of marking agent from the surface which was not transferred using transfer member 48. However, sometimes residual imaging oil remains within the seam region 60 which can result in imaging defects if contacted by charge roller 42.

As shown in FIGS. 2-3, in some embodiments, printer 20 includes a positioning control system 80 configured to control a position of one or both of charge roller 42 and photoconductor 40 relative to the other, as will be further described later in association with FIGS. 4-12. In one aspect, positioning control system 80 operates to maintain charge roller 42 at minimum spacing from seam region 60 of photoconductor 40. Accordingly, charge roller 42 is configured to rollingly engage non-seam region 62 of photoconductor 40 as shown in FIG. 2 and to be provided in a spaced relationship with respect to seam region 60 as shown in FIG. 3.

In some embodiments, as shown in FIGS. 2-3, charge roller 42 is oriented elevationally above photoconductor 40 such that axis 43 of charge roller 42 is located directly over axis 41 of photoconductor 40 (e.g., in a direction normal to a surface of photoconductor 40 at nip location 64). In one aspect, a position of axis 41 of photoconductor 40 is fixed while charge roller 42 is movable (relative to axis 43) in a substantially vertical direction as illustrated and described below. In other embodiments, axis 43 may be fixed while axis 41 is configured to move or in some embodiments, both axes 41, 43 may move.

According to the embodiment of FIGS. 2-3, wherein axis 41 is fixed and axis 43 is movable, gravity imparts a gravitational force upon charge roller 42 to urge charge roller 42 against photoconductor 40. In some embodiments, the diameter of one or both of photoconductor 40 and charge roller 42 vary slightly over time, and arranging photoconductor 40 and charge device 42 as shown (e.g., wherein axis 43 of charge device 42 may move) maintains contact between charge device 42 and non-seam region 62 of photoconductor 40 regardless of whether the diameter of one or more of photoconductor 40 or charge device 42 becomes smaller over time. In another aspect, charge roller 42 is raised upward if the diameter of one or both of photoconductor 40 or charge device 42 increases.

In other embodiments, axes 41, 43 are offset with respect to another, such as axis 43 of charge roller 42 being positioned approximately fifteen degrees off vertical. In this arrangement, gravitational forces still act as a biasing force to urge charge roller 42 in rolling engagement against non-seam region 62 of photoconductor 40.

In one aspect, position control system 80 is configured to prevent entry of charge roller 42 into seam region 60 of photoconductor 40, and therefore, reduce or prevent residual imaging oil in seam region 60 from being transferred to charge roller 42. In one implementation, as shown in FIGS. 2-3, positioning control system 80 is configured to maintain a substantially constant distance "d" between the respective axes 41, 43 during rotations of photoconductor 40 and charge roller 42 with this distance "d" being substantially constant whether the charge roller 42 contacts non-seam region 62 (FIG. 2) or seam region 60 is passing through nip location 64 (FIG. 3). It will be understood that, in some embodiments, distance "d" may vary over time (e.g., slightly) corresponding to fluctuations in diameter of one or both of photoconductor 40 and charge device 42. Accordingly, the substantially constant distance refers to temporally related moments in time for example during imaging of one or more temporally related imaging jobs and is not intended to refer to the life of printer 20.

Figure 4:
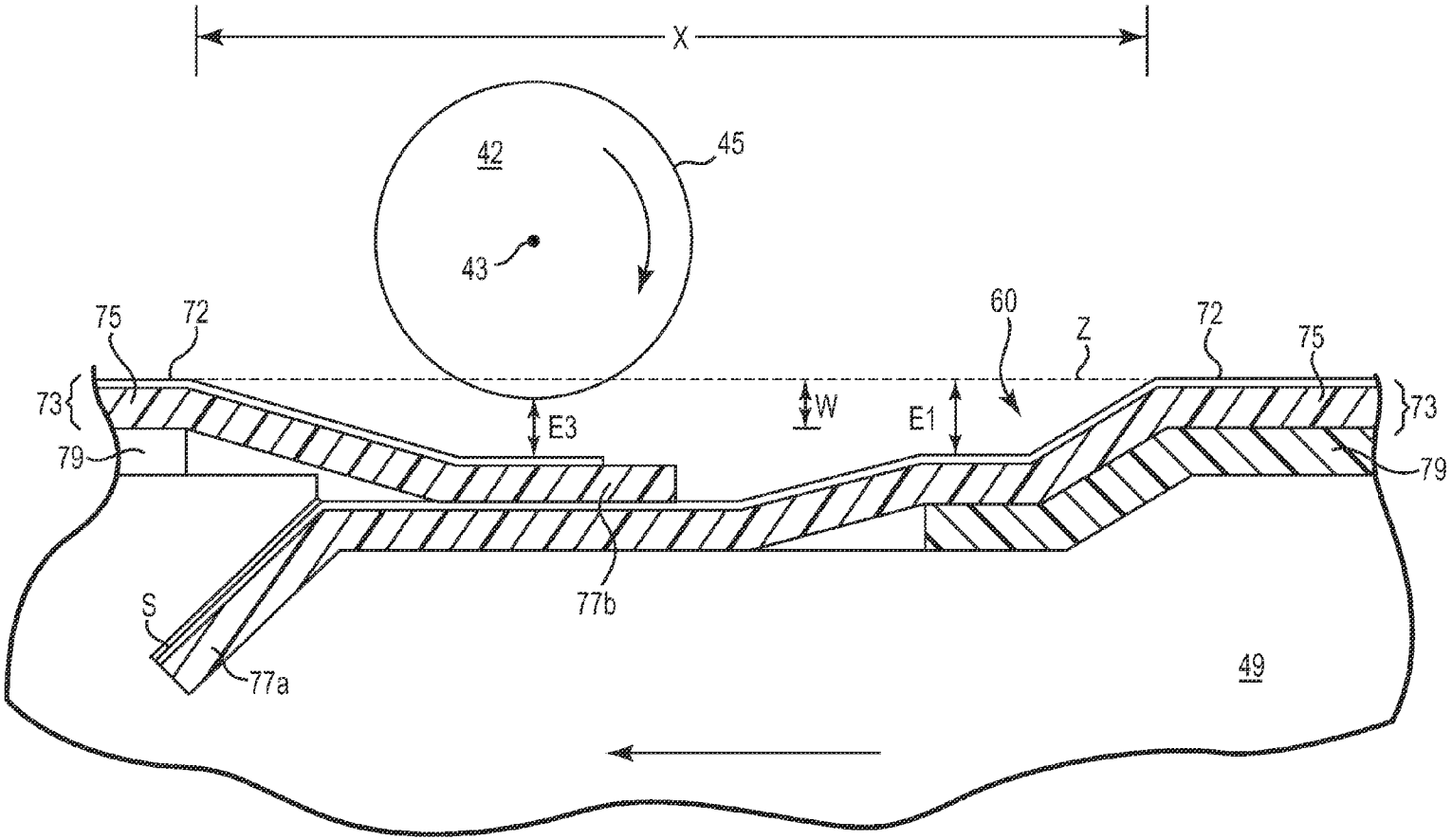
FIG. 4 is an enlarged partial sectional view of a seam region of a photoconductor of a press, according to an embodiment of the present disclosure.
Figure 5:
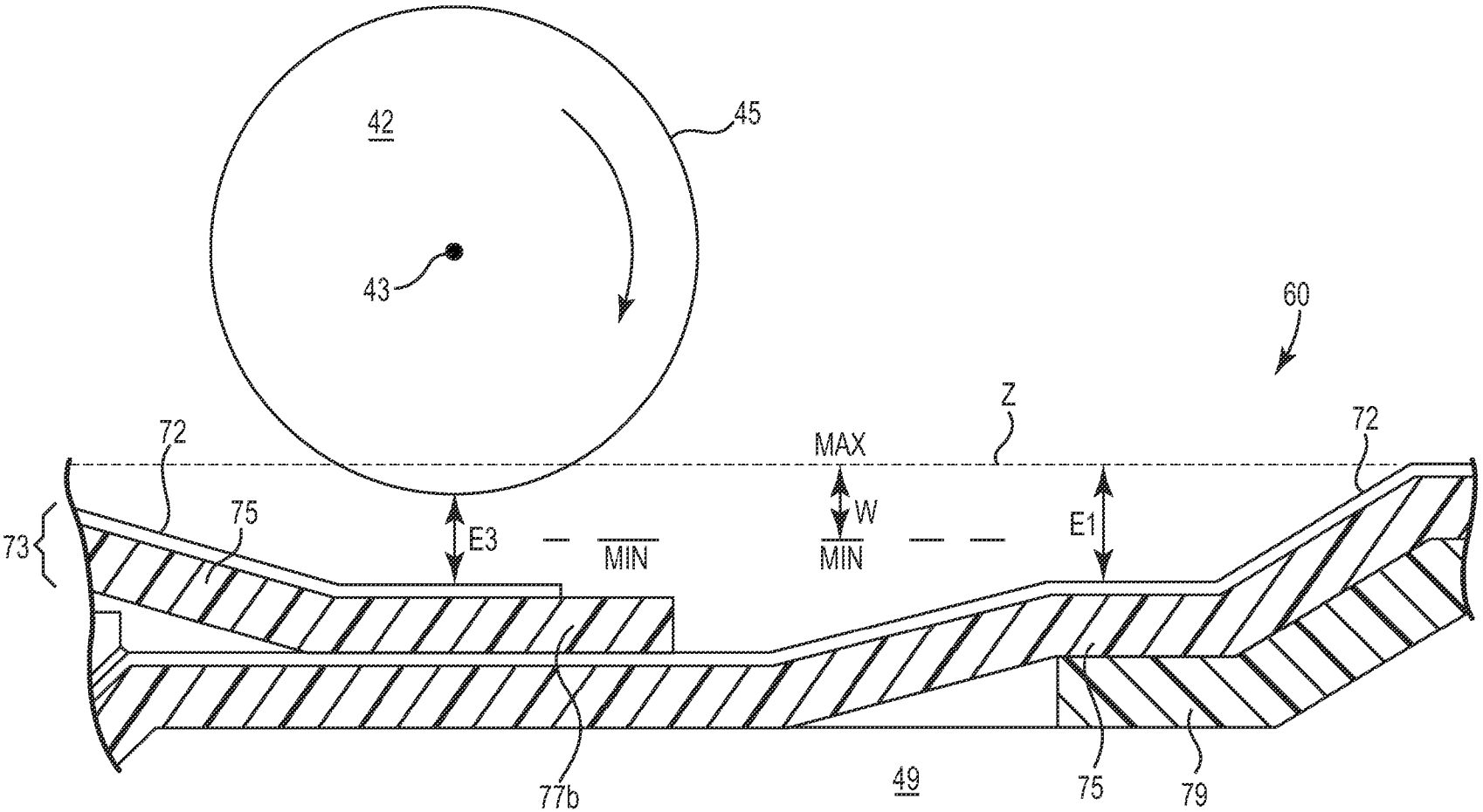
FIG. 5 is an enlarged view of FIG. 4, according to an embodiment of the present disclosure.

FIGS. 4-5 are enlarged partial sectional views schematically illustrating a recessed seam region 60, where photoconductor drum 49 has photoconductor sheet 73 wrapped about the circumference thereof. Photoconductor sheet 73 includes outer photoconductive surface 72 on a base film 75, such as Mylar, and is sometimes referred to as a photo imaging plate (PIP) foil. As shown in FIG. 4, a first end 77*a* of sheet 73 is retained in a slot S of drum 40, while a second end 77*b* of sheet 73 overlaps sheet 73 in seam region 60 adjacent first end 77*a*. In one embodiment, a cushioning substrate 79 is provided between drum 49 and sheet 73. Charge roller 42 is illustrated extending slightly into seam region 60 (i.e., below the level of the dashed line Z), which reflects relaxation of charge roller 42 that occurs when compression forces are removed temporarily after charge roller 42 is no longer compressed against outer surface 22 of photoconductor 40.

In one embodiment, a charge roller assembly described below operates to maintain a position of outer surface 45 of charge roller 42 within a target position window (as represented by indicator W) as seam region 60 passes underneath charge roller 42. In one aspect, target positioning window (W) represents a range of target positions for outer surface 45 of charge roller 42 for which adequate spacing is maintained relative to surface 22 (including surface 72 in FIGS. 4-5) of seam region 60. In one embodiment, the target position window (W) includes a range from about 90 to 160 microns of spacing between outer surface 45 of charge roller 42 and surface 72 of seam region 60. In some embodiments, the range extends from about 110 microns to about 155 microns.

As further shown in FIGS. 4-5, the upper dashed line (labeled MAX) represents an upper limit of spacing between outer surface 45 of charge roller 42 and surface 72 of seam region 60 while the lower dashed line (labeled MIN) represents a lower limit of spacing between outer surface 45 of charge roller 42 and surface 72 of seam region 60. In one example, the distance E3 between outer surface 45 of charge roller 42 and surface 72 represents a spacing of about 130 microns, which falls within the target position window (W).

By maintaining a desired spacing (between outer surface 45 of charge roller 42 and surface 72 of seam region 60), a position control system 80 prevents or minimize oil pickup from seam region 60, minimizes bouncing time associated with seam region 60, and ensures that an adequate charge will be maintained at surface 72 despite the lack of contact between charge roller 42 and surface 72.

In another aspect, as shown in FIGS. 4-5, the identifier x represents a length of seam region 60. This length is used is some embodiments as one of several parameters to determine a duration for which a positioner will limit a vertical position of a charge roller when seam region 60 passes underneath the charge roller.

As described below in association with FIGS. 6A-13, embodiments of the present disclosure provide high resolution positioners for a charge roller to ensure that the charge roller will be within the target position window as seam region passes underneath the charger roller.

Figure 6A:
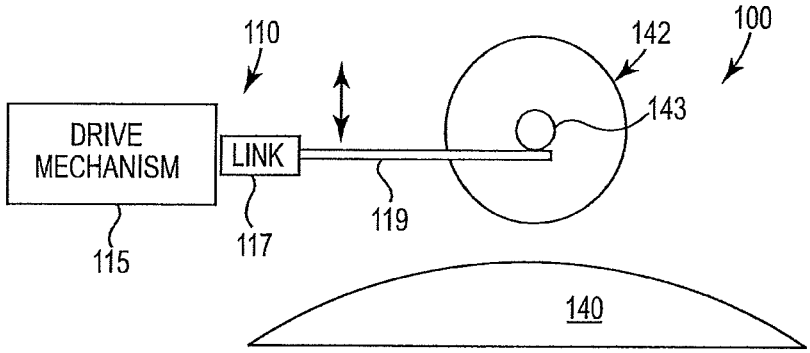
FIGS. 6A-6C are front plan views that schematically illustrate a charge roller assembly, according to an embodiment of the disclosure, with each Figure depicting the charge roller in a different position relative to a photoconductor.
Figure 6B:
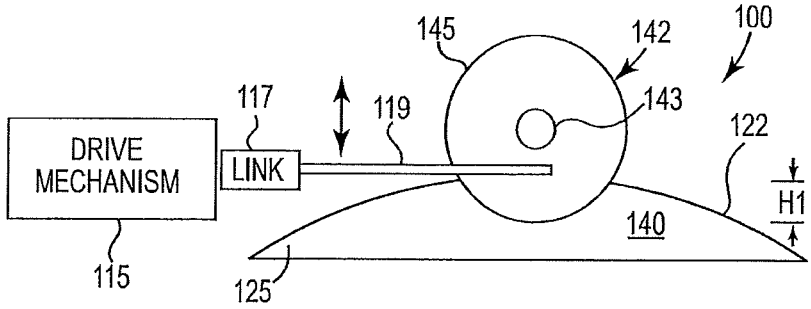
Figure 7:
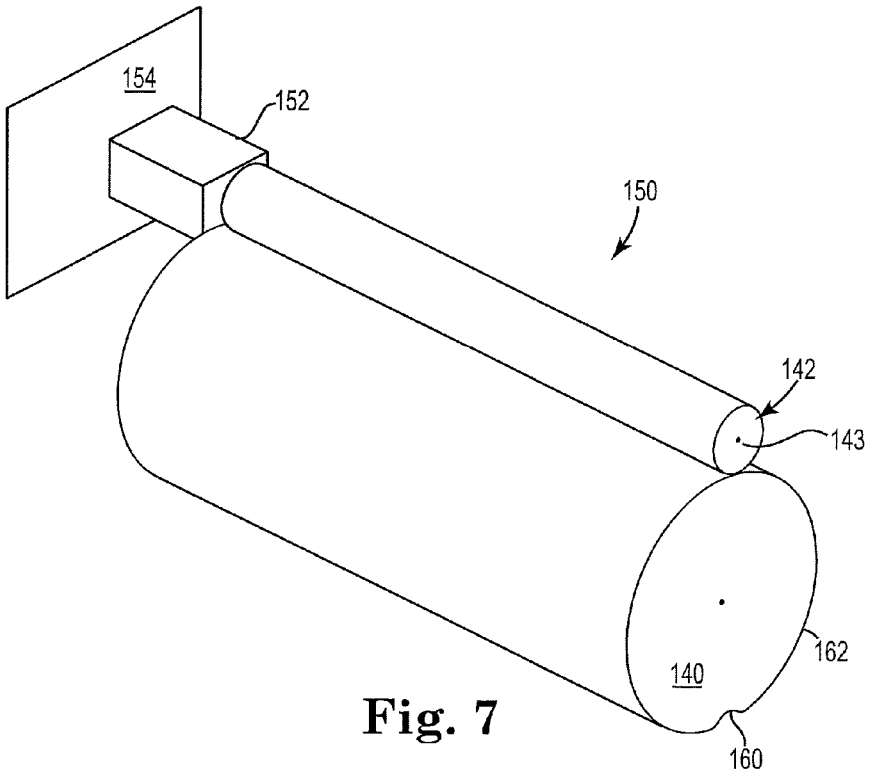
FIG. 7 is a perspective view schematically illustrating a charge roller assembly and photoconductor, according to an embodiment of the present disclosure.

FIGS. 6A-6B are a series of diagrams that schematically illustrate a charge roller assembly 100, according to an embodiment of the present disclosure, in different states of operation. FIG. 7 is perspective view of printer 150, providing one example in which charge roller assembly 100 is incorporated. As shown in FIG. 7, charge roller assembly 100 is supported by frame 154 and supports engagement of charge roller 142 against photoconductor 140.

With further reference to FIG. 6A, charge roller assembly 100 includes (but is not limited to) charge roller 142 with central support 143 and positioner 110. In one aspect, central support 143 corresponds to a structure which is aligned with and/or includes a rotational axis (e.g. axis 43 in FIGS. 1-3) of charge roller 142. In one embodiment, positioner 110 includes drive 115 and linkage 117 that is positioned and oriented to operably couple drive 115 to charge roller 142, when linkage 117 releasably engages central support 143 of charge roller 142. While linkage 117 can take a variety of forms, in the example shown in FIG. 6A, a portion of linkage 117 is schematically represented as a rigid member 119, which extends transversely to intersect with a path of vertical movement of charge roller 142 due to gravitational forces (and/or by a spring biasing charge roller 142 to move downward). In this arrangement, rigid member 119 is configured to releasably contact central support 143 and prevent any downward movement of charge roller 142 below linkage 117. Accordingly, drive 115 controls a vertical position of rigid member 119 of linkage 117, which in turn constrains downward movement of charge roller 142 when rigid member 119 is releasably engaged against central support 143 of charge roller 142.

In some embodiments, drive 115 comprises a discrete step drive, which produces motion in discrete steps such that a rotational or linear position of a shaft driven by the stepper motor moves one step at a time rather than as part of a continuous motion. In one aspect, the stepper motor controls a direction of motion of the drive shaft, a speed of rotation of the drive shaft or speed of linear translation of the drive shaft (depending upon whether the motion is linear or rotational), and starting/stopping of motion of the drive shaft. In one embodiment, discrete step drive 115 includes a stepper linear actuator, as further described later in association with FIGS. 10-11, to provide linear movement of a drive shaft. In other embodiments, discrete step drive 115 includes a stepper rotational actuator, as further described later in association with FIGS. 12-13, to provide rotational movement for causing rotation of a cam (as part of a linkage) used to control an elevation of charge roller 142 relative to photoconductor 140.

Figure 6C:
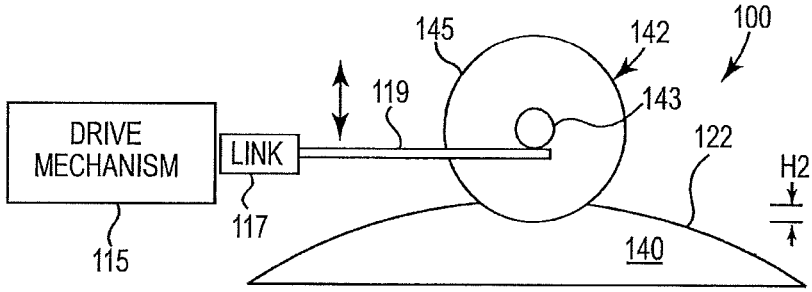

Prior to general operation of printer 20, an operating position of charge roller 142 is established. It will be understood that this determination of the operating position of charge roller 142 is generally made when first setting up printer 20 for operation and/or during periodic maintenance to ensure optimum performance. One initial step includes removing the influence of rigid member 119 on central support 143. Accordingly, drive 115 is operated to cause linkage 117 to move rigid member 119 vertically downward far enough (as shown in FIG. 6B) to allow gravitational forces to act freely, thereby permitting charge roller 142 to rest on outer surface 122 of photoconductor drum 140. As shown in FIG. 6B, in doing so, both the outer surface 122 of photoconductor 140 and the outer surface 145 of charge roller 142 become compressed by the weight of charge roller 142. It will be further understood that the degree of compression shown in FIGS. 6B-6C is exaggerated for illustrative purposes. As shown in FIG. 6B, the compression at the nip 164 results in a nip height of H1.

Next, as shown in FIG. 6C, drive 115 is operated, via linkage 117, to move rigid member 119 vertically upward until rigid member 119 just contacts central support 143 of charge roller 142, thereby establishing a core contact point between rigid member 119 and charge roller 142. From this point, drive 115 further moves rigid member 119 (via linkage 117) upward one step at a time until a desired elevation or operating position of charge roller 142 is achieved relative to outer surface 122 of photoconductor 140. In this operating position, outer portion 145 of charge roller 142 retains some compression, as does outer portion 122 of photoconductor 140, in order to maintain firm contact between charge roller 142 and photoconductor 140. In one aspect, this degree of compression that occurs between charge roller 142 and photoconductor during normal operation of printer 20 is represented by nip height (H2). In one embodiment, a target nip height (H2) is about 100 microns.

In one aspect, it is known that the degree of compression exhibited by the respective outer portions of charge roller 142 and photoconductor 140, which becomes relaxed later in seam region 160, will not result in outer portion 145 of charge roller 142 touching seam region 160 because: (1) the maximum relaxation of charge roller 142 is substantially less than a depth of seam region 160; and (2) linkage 117 of positioner 110 prevents charge roller 142 from dipping far enough into seam region 160 to make contact.

Unlike conventional systems, positioner 110 is configured maintain minimum spacing to avoid charge roller 142 from dropping into seam region but does so without adding unnecessary spacing, which would otherwise interfere with maintaining a desired charge on outer surface 122 of photoconductor 140 as the seam region 160 passes underneath charge roller 142.

Figure 8:
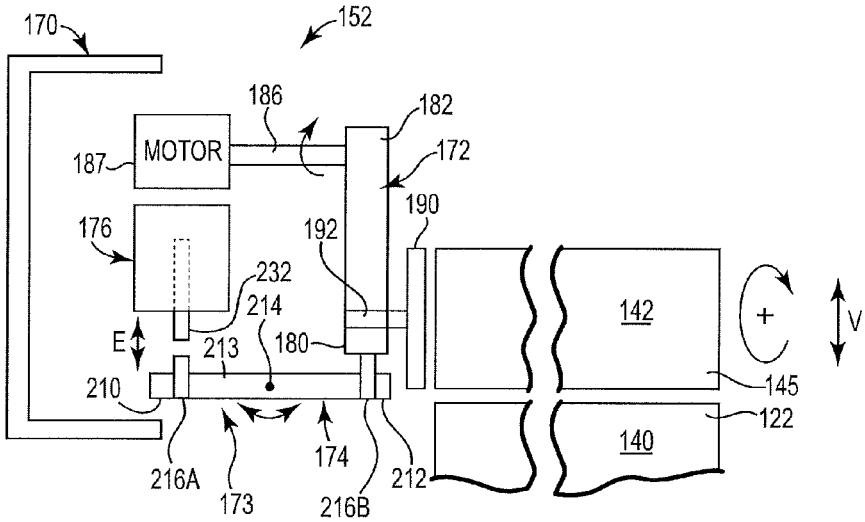
FIG. 8 is a side plan view of a charge roller assembly, according to an embodiment of the present disclosure.
Figure 9:
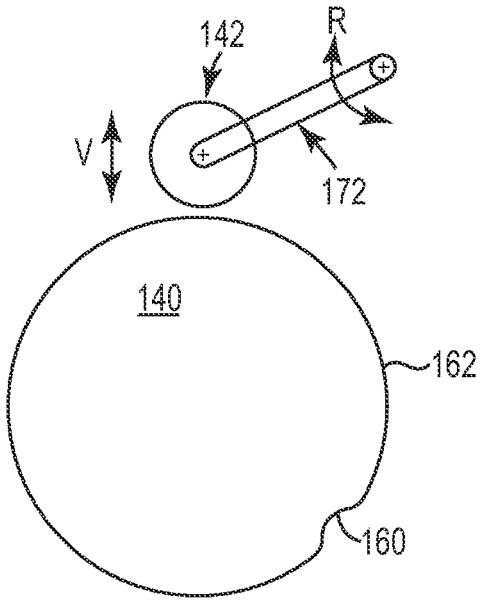
FIG. 9 is front plan view of a charge roller assembly, according to an embodiment of the present disclosure.

FIG. 8 is a side plan view schematically illustrating a charge roller assembly 152, according to an embodiment of the present disclosure. In one embodiment, charge roller assembly 152 comprises at least substantially the same features and attributes as charge roller assembly 100, as previously described and illustrated in association with FIGS. 6A-6C and 7. As shown in FIG. 8, a frame 170 supports the components of charge roller assembly 152 and is generally positioned and aligned to support charge roller 142 in rolling engagement with photoconductor 140 (shown in FIG. 7).

In one embodiment, charge roller assembly 152 includes a first arm 172, a motor 187 and a positioner 173, which includes at least a second arm 174 and drive 176. First arm 172 of assembly 152 includes first end 180 and second end 182, with second end 182 mounted relative to frame 170 via pivot arm 186. In one aspect, first arm 172 extends generally transversely to a longitudinal axis or rotational axis of charge roller 142 such that pivot arm 186 is spaced laterally from charge roller 142. A motor 187 mounted relative to frame 170 supports pivot arm 186 and controls pivoting of first arm 172 (as represented by directional arrow R in FIG. 9) to cause raising or lowering of charge roller 142 (as represented by directional arrow V in FIG. 9) relative to photoconductor 140. Via coupling 192, first end 180 of arm 172 supports a disc 190 configured to mount charge roller 142 and to permit rotation of charge roller 142 (as represented by directional arrow T).

In one aspect, motor 187 and pivot arm 186 (and/or an associated coupling) are configured with a release feature to allow gravity to act on weight of charge roller 142 to permit charge roller to rest freely on photoconductor 142, as demonstrated in association with FIG. 6B, during initial positioning of charge roller 142. However, when it is desired to fully disengage charge roller 142 from photoconductor 140, motor 187 and pivot arm 186 act together to rotate arm 172, and thereby vertically raise charge roller 142 (as represented by vertical motion indicator V).

Second arm 174 of positioner 173 includes first end 210, second end 212, and pivot portion 214 at a midportion of arm 174. At each respective end 210, 212, second arm 173 supports a conductive element 216A, 216B, respectively, in a vertical orientation. Each conductive element 216A, 216B includes a tip that protrudes from a top surface 213 of second arm 174. Second arm 174 is positioned so that second end 212 and conductive element 216B are aligned directly underneath second end 180 of first arm 172 for making releasable contact against second end 180. Meanwhile, first end 210 of second arm 174 is aligned directly underneath drive shaft 232 of drive 176 to enable drive shaft 232 to make releasable contact against conductive element 216A at first end 210 of second arm 174. In this way, second arm 174 forms a linkage, along with first arm 172, to operably couple drive 176 to charge roller 142 to enable controlling a vertical position of charge roller 142 relative to photoconductor 140.

In one embodiment, drive 176 comprises a stepper linear actuator having at least substantially the same features and attributes, as previously described in association with FIGS. 6A-6C.

In some embodiments, as shown in FIG. 8, drive 176 comprises a discrete step drive, which causes drive shaft 232 to move in linear translation toward and away from conductive element 216A of second arm 174 in discrete steps. In other words, movement of drive shaft 232 occurs in discrete uniform steps, which occur one at a time. In one embodiment, discrete step drive 176 moves drive shaft 232 a distance of 31 microns for each step. Accordingly, with this high resolution drive 176, the position of axis 143 of charge roller 142 is about 31 microns for each step movement caused by drive 176. However, it will be understood that in other embodiments, a drive 176 will cause lesser (less than 31 microns) or greater (more than 31 microns) movement for each step.

Keeping this general arrangement in mind, the initial operational positioning of charge roller 142 includes first letting charge roller 142 rest on photoconductor 140 (as previously described in association with FIG. 6B) via action of gravitational forces by having drive 176 withdraw drive shaft 232 to a point at which second arm 174 does not limit downward vertical movement of first arm 172, and thereby, does not limit the vertical position of charge roller 142. This maneuver produces maximum compression (at least due to gravitational forces acting on charge roller 142) of the outer portion 145 of charge roller 142 and of outer portion 125 of photoconductor 140.

Next, as part of establishing a desired operational position of charge roller 142, drive 176 is engaged to move drive shaft 232 one step at a time (via a calibration algorithm) until drive shaft 232 just touches conductive element 216A, thereby electronically indicating that drive 176 has set a limit via contact with first end 210 of arm 174. Hereafter, drive 176 is further engaged to move drive shaft 232 a few more steps, thereby causing first end 210 to move vertically downward, and via pivot portion 214, thereby cause second end 212 and conductive element 216B to move first end 180 of first arm 172 vertically upward, thereby vertically raising charge roller 142 relative to photoconductor 140. This maneuver is performed to achieve a desired polyurethane nip height between the charge roller 142 and photoconductor 140, such as nip height H2 previously described in association with FIG. 6C, corresponding to an operational target of printer 20. Once this adjustment is achieved, then the position of drive shaft 232 is maintained indefinitely during normal operation of printer 20 to make static the position of second arm 174. Accordingly, via positioner 173 (including drive 176 and the linkage provided via arm 174), a limit is established for downward vertical movement of the charge roller 142 relative to photoconductor 140 such that when seam region 160 passes underneath over charge roller 142 (FIGS. 3 and 7), charge roller 142 will not contact the surface of seam region 160 or dip to far into seam region 160.

Because the charge roller 142 will not contact seam region 160 of photoconductor, a higher voltage is applied via charge roller 142 in seam region 160 to maintain a desired charge on the outer surface 22 (e.g. PIP foil) of photoconductor 140. Moreover, because the increased distance between charge roller 142 and surface 122 of photoconductor 140 in the seam region 160 makes maintaining a charge more difficult, it is worth noting that the highly accurate positioning achieved via positioner 173 (including drive 176 and arm 174) ensures that no more than the minimum distance is provided between charge roller 142 and seam region 160. In one aspect, using any one of several calibration schemes, the number of steps made by drive 176 is correlated with the target position window (W in FIGS. 4-5) such that positioner 173 ensures that the position of outer surface 145 of charge roller 142 falls within the target position window.

In some embodiments, further calibration is performed to account for roller diameter tolerances which are larger than a target position window (previously described in association with FIGS. 4-5).

In one aspect, by automatically preventing charge roller 142 from descending too far down into seam region 160, charge roller assembly 152 eliminates use of a sensor that is commonly found in conventional charge roller systems to directly sense the presence of seam region 160 for triggering position-control mechanisms of a charge roller.

Figure 10:
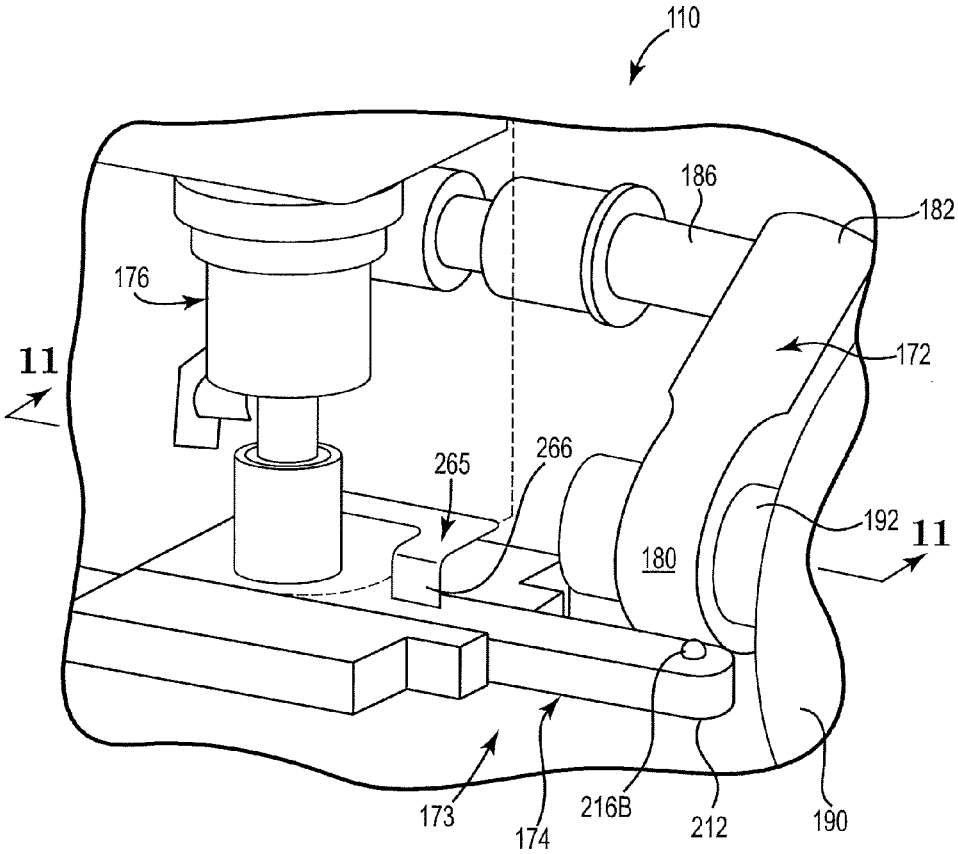
FIG. 10 is a perspective view schematically illustrating a charge roller assembly with a positioner for a charge roller, according to an embodiment of the present disclosure.

FIG. 10 is a perspective view that further schematically illustrates charge roller assembly 110 and positioner 173, according to an embodiment of the present disclosure. As shown in FIG. 10, positioner 173 further comprises a first leaf spring 265 having an end 266. First leaf spring 265 biases first end 210 of second arm 174 downward, which by virtue of pivot point 214, biases second end 212 (via conductive element 216B) of second arm 174 to maintain contact with first end 180 of first arm 172. With this arrangement, positioner 173 ensures that movement of drive shaft 232 from drive 176 is the operative variable in limiting a vertical position of charge roller 142, and that no gap need be accounted for between second end 212 of second arm 174 and first end 180 of first arm 172.

Figure 11:
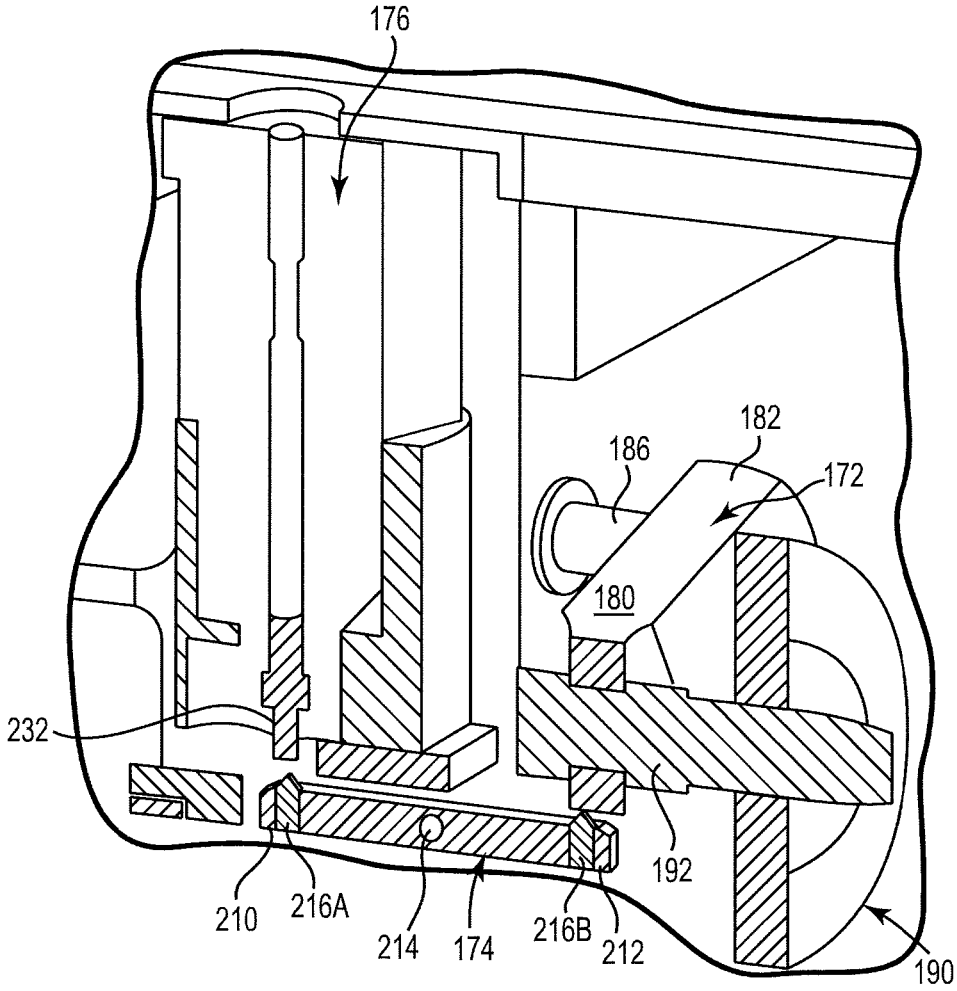
FIG. 11 is a sectional view as taken along lines 11-11 of FIG. 10, according to an embodiment of the present disclosure.

FIG. 11 is a sectional view of charge assembly 110 as taken along lines 11-11 of FIG. 10, according to an embodiment of the present disclosure. FIG. 11 further reveals the interconnection and interaction of first arm 172, second arm 174, drive shaft 232 of drive 176, and coupling 188 of disc 190 (which couples to charge roller 142), as previously described in association with FIGS. 8 and 10.

Figure 12:
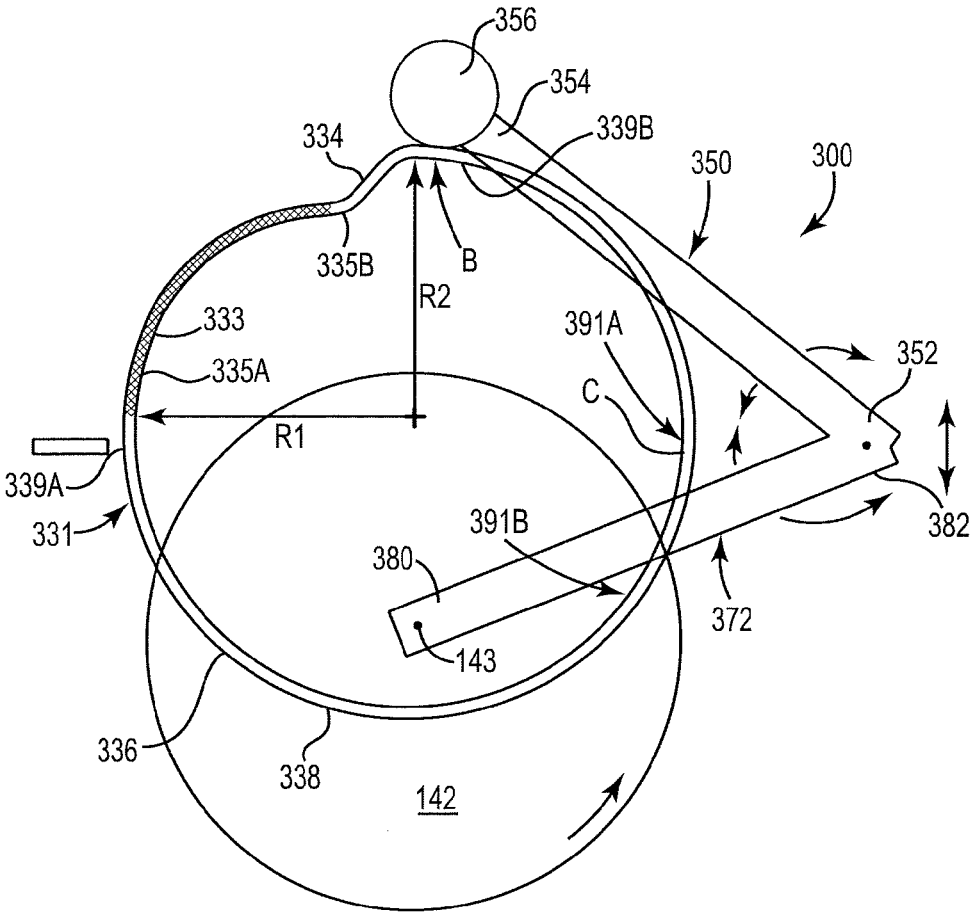
FIG. 12 is a front plan view schematically illustrating a charge roller assembly including a positioner for a charge roller, according to an embodiment of the present disclosure.
Figure 13:
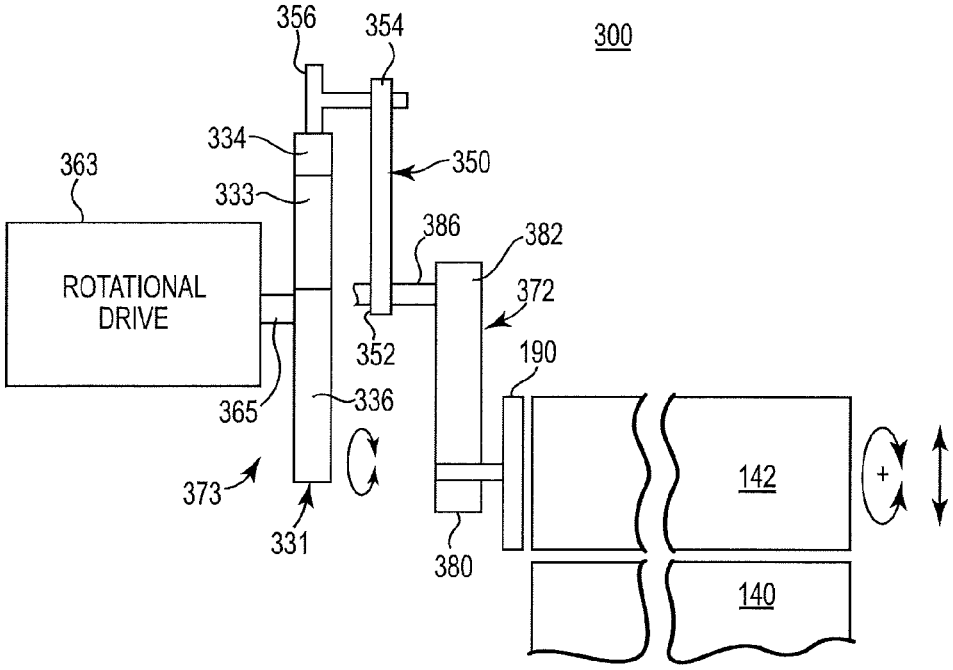
FIG. 13 is a side plan view schematically illustrating a charge roller assembly including a positioner for a charge roller, according to an embodiment of the present disclosure.

FIG. 12 is a front plan view and FIG. 13 is a side plan view, respectively, that schematically illustrates a charge roller assembly 300, according to an embodiment of the present disclosure. In one embodiment, charge roller assembly 300 is provided as an alternative to charge roller assembly 152 (described in association with FIGS. 8-11) to control a position of a charge roller relative to a seam region of a photoconductor.

As shown in FIGS. 12-13, charge roller assembly 300 includes charge roller 142, first arm 372, and positioner 373, which includes at least cam 331, second arm 350, and rotational drive 363. First arm 372 includes first end 380 coupled to charge roller 142 and a second end 382. Second arm 350 of positioner 373 includes first end 352, which is fixed to pivot arm 386 (FIG. 13) and a second end 354 defining a cam follower 356. In one aspect, cam follower 356 defines a generally circular shape while in other embodiments, cam follower 356 comprises other arcuate shapes. Together, cam 331 and second arm 350 (including cam follower 356) provide a linkage between rotational drive 363 and pivot arm 386 associated with charge roller 142 (via first arm 372 as shown in FIG. 13). Further, it will be understood that positioner 373 works in cooperation with other components of charge roller assembly 300, such as first arm 372 (and an associated motor like motor 187 in FIG. 8) for causing rotation of pivot arm 386 to control a position of charge roller 142 relative to photoconductor 140.

As further shown in FIG. 12, cam 331 is a generally disc-shaped element and includes a disengaging portion (represented via cross-hatched segment 333) and an engaging portion 336 defining a variable radius contour 338 extending from a minimum radius point 339A (also represented by radius R1) to a maximum radius point 339B (also represented by radius R2). In one embodiment, radius R1 at minimum radius point 339A is about 38 millimeters while radius R2 at maximum radius point 339B is about 42 millimeters. A transition zone 334 is formed between maximum radius point 339B and disengaging portion 333 and having a radius at first end 335A of about 38 millimeters and a radius at second end 335B of about 33 millimeters.

With reference to FIG. 13, cam 331 is operably coupled to and rotationally supported by rotational drive 363, which causes and controls rotational movement of cam 331. In particular, rotational drive 363 controls a direction of rotation of drive shaft 365, a speed of rotation of drive shaft 365, as well as controlling the initiation and termination of rotation of drive shaft 365. In one aspect, rotational drive 363 is a discrete step drive, which rotates one increment or step at a time in order to provide highly precise and accurate control over movement of drive shaft 365. In one embodiment, rotational drive 363 comprises a rotational stepper actuator, as known in the art. In one embodiment, each rotational step of rotational drive 363 produces about 13 microns rotational movement of the contour 338 of cam 331. Accordingly, cam 331 provides a high resolution reference point for accurately controlling spacing of charge roller 142 relative to seam region 160 of photoconductor 140.

In order to identify an operational position of charge roller 142 which will not contact seam region 160 of a photoconductor 140, a segment of cam 331 is identified which will result in a corresponding target position of charge roller 142. To do so, cam 331 is rotated one step at a time relative to cam follower 356, with cam 331 initially positioned beginning at first radius point 339A and cam 331 rotating an initial number of steps (e.g. 50 steps) expected to correspond with arrival of cam follower 356 at a target calibration point (C). The target calibration point, in turn, is expected to correspond to a target spacing of charge roller 142 relative to photoconductor (e.g. within a target position window shown in FIGS. 4-5) when seam region 160 passes underneath charge roller 142 such that charge roller 142 would be prevented from contacting seam region 160. In one embodiment, as further shown in FIG. 12, charge roller assembly 300 includes a homing sensor positioned and configured to recognize a starting and ending position of operative region 336 of cam 331.

Once a calibration point (C) is identified, this location sets a first end 391A of a range of rotation of cam 331 relative to cam follower 356 during normal operation of printer with this point corresponding to limiting downward vertical movement of charge roller 142. Further calibration of charge roller assembly 300 identifies a second end 391B of an operational range of cam 331 relative to cam follower 356 with this second end 391B corresponding with charge roller 142 rolling on non-seam region 162 of photoconductor 140 (FIG. 9) with a target nip height (H2 in FIG. 6C) between charge roller 142 and photoconductor 140. During normal operation of printer 20, cam 331 rotates such that cam follower 356 is slidably moved between these two ends 391A, 391B of operational range of cam 331, thereby providing a dynamic limit on the vertical position of charge roller 142 relative to photoconductor 140. In particular, when seam region 160 passes underneath charge roller 142, cam follower 356 is positioned at second end 391B of operational range of cam 331 which causes second arm 350 to rotate pivot arm 386 (FIG. 13), which raises charge roller 142 relative to photoconductor 140, such that a greater spacing is caused between axis 143 of charge roller 142 and axis of photoconductor 140. This relationship, in turn, ensures that outer surface 145 of charge roller 142 falls within the target position window to maintain proper spacing relative to seam region 160 of photoconductor 140.

When charge roller 142 resumes contact with non-seam region 162 of photoconductor 140, cam follower 356 is in sliding contact with the remaining portion of operational range of cam 331, which has a smaller radius than the radius at second end 391B. This relationship results in second arm 350 (extending from cam follower 356) dropping vertically, which in turn causes rotation of pivot arm 386 to allow charge roller 142 to descend vertically, and thereby rollingly engage outer surface 122 of photoconductor 140 at a target nip height (e.g. H2 in FIG. 6C) between charge roller 142 and photoconductor 140.

While the difference in vertical positions of charge roller 142 (relative to photoconductor 140) based on the positions of cam 331 (relative to cam follower 356) within the operational range is not particularly large, the difference produces a dynamic situation in which the vertical position of axis 143 of charge roller 142 is not static throughout a complete revolution of photoconductor 140. Rather, the vertical position of axis 143 of charge roller 142 is higher in the seam region 160 and generally lower in the non-seam region 162 of photoconductor 140.

In another embodiment, in order to facilitate maintaining a charge in the seam region 160, the dynamic vertical positioning of charge roller 142 is used to bring charge roller 142 slightly closer to seam region 160 (but without contacting seam region 160 when seam region 160) passes underneath charger roller 142 in order to reduce the magnitude of the second higher voltage applied by charge roller 142 in the seam region 160.

It will be further understood that rotation of cam 331, via drive 363, cycles between clockwise and counterclockwise rotation as cam 331 moves relative to cam follower 356 through the operational range of cam 331 for a particular charge roller 142. Accordingly, upon cam follower 356 reaching one of respective ends 391A, 391B of operational range of cam 331 (for a particular charge roller), drive 363 reverses the rotational direction of drive shaft 365 to reverse the rotational direction of cam 331, so that cam follower 356 can continue to slidably move through the operational range of cam 331, albeit in the opposite direction. This cycle is repeated for each revolution of photoconductor 140.

It will be understood that the rotational motion of cam 331 relative to cam follower 356 as described and illustrated in association with FIGS. 12, 14 is just one example, and that cam 331 and cam follower 356 can take a variety of shapes and configurations to enable controlling a vertical position of charge roller 142 relative to photoconductor 140 when seam region 160 passes underneath charge roller 142 such that charge roller 142 does not dip into and does not contact a surface of seam region 160.

It will be understood that from the foregoing description and FIGS. 12-13 that cam 331 and cam follower 356 are independent of and separate from photoconductor 140. In other words, while the rotation of cam 331 and corresponding tracking movement of cam follower 356 (relative to cam 331) are arranged to control a position of charge roller 142 in view of the rotation of photoconductor 140 and the position of seam region 160, the rotation of cam 331 is determined according to drive 363 and not according to the rotation of photoconductor 140.

Moreover, in another aspect, positioner 373 controls the position of charge roller 142 relative to seam region 160 of photoconductor without using a sensor as otherwise employed in conventional positioning systems that directly sense a position of seam region 160 as photoconductor 140 rotates.

Embodiments of the present disclosure provide a positioner to prevent charge roller from contacting a surface of a seam region of a photoconductor. In one aspect, accurate and precise control over the position of the charge roller is achieved via a discrete step drive. In one embodiment, the drive comprises a stepper linear actuator coupled to the charge roller via a first linkage. In other embodiments, the drive comprises a stepper rotational actuator coupled to the charge roller via a cam and cam follower assembly. In addition, in another aspect, a charge roller assembly includes a voltage applicator configured to apply a higher voltage through charge roller in the seam region. With these arrangements, a desired charge is maintained at the outer surface of the photoconductor while preventing the charge roller from bottoming out into the seam region of the photoconductor, which would otherwise result in picking up oil from the seam region.

Although specific embodiments have been illustrated and described herein, it will be appreciated by those of ordinary skill in the art that a variety of alternate and/or equivalent implementations may be substituted for the specific embodiments shown and described without departing from the scope of the present disclosure. This application is intended to cover any adaptations or variations of the specific embodiments discussed herein. Therefore, it is intended that this present disclosure be limited only by the claims and the equivalents thereof.

What is claimed is:

1. A printer comprising:

a photoconductor including an outer surface defining a seam region and a non-seam region;

a single charge roller; and a positioner operably coupled to the single charge roller and configured to cause the single charge roller to rollingly engage the outer surface of the non-seam region through repeated revolutions of the photoconductor, wherein the positioner includes a discrete stepper rotational actuator configured to maintain the single charge roller between a minimum and maximum spacing relative to the seam region of the outer surface when the seam region passes underneath the single charge roller, and wherein the positioner comprises:

a cam follower; and a cam coupled to a driveshaft of the stepper rotational actuator, wherein the stepper rotational actuator is configured to cause the cam to move in a range of motion corresponding to a partial revolution of the cam along a variable radius contour of the cam such that contact of the cam follower against a first portion of the variable radius contour causes the single charge roller to be in rolling engagement against the outer surface of the photoconductor and contact of the cam follower against a second portion of the variable radius contour causes the single charge roller to be spaced apart from the seam region of the photoconductor, and wherein a combination of a first instance of the partial revolution of the cam in a first direction and of a second instance of the partial revolution of the cam in an opposite, second direction corresponds to a complete revolution of the photoconductor.

2. The printer of claim 1, wherein the minimum spacing is at least 110 microns and a maximum spacing between the charger roller and the seam region is no more than about 155 microns.

3. The printer of claim 1, wherein the positioner includes:

a first arm having a first end and a second end, the first end pivotally coupled to a rotational axis of the charge roller and the second end fixed to a pivot mechanism; and a second arm including a first end and a second end, the first end coupled to the second end of the first arm and the second end defining the cam follower, wherein the second arm has a length sufficient to enable the cam follower to slidably engage a surface of the cam.

4. The printer of claim 1, comprising:

a voltage controller coupled to the charge roller and configured to apply a first voltage to the non-seam region and to apply a second voltage, substantially greater than the first voltage, to the seam region.

5. A printer comprising:

a photoconductor including an outer surface defining a seam region and a non-seam region;

a charge roller configured to rollingly engage the outer surface of the non-seam region; and a positioner operably coupled to the charge roller and including a discrete step drive configured to maintain a minimum spacing between the charge roller and the seam region of the outer surface when the seam region passes underneath the charge roller, wherein the discrete step drive comprises a stepper rotational actuator, and wherein the positioner operates without the use of a seam-position sensor, and wherein the positioner comprises:

a cam coupled to a driveshaft of the stepper rotational actuator, wherein the stepper rotational actuator is configured to cause the cam to move in a range of motion corresponding to a partial revolution of the cam, wherein the cam includes a variable radius contour in which a radius increases from a first end to a second end; and a cam follower wherein contact of the cam follower against a portion of the variable radius contour causes the charge roller to be spaced apart from the seam region of the photoconductor.

6. A charge roller assembly comprising:

a single cylindrical charge roller;

a first arm including a first end and a second end with the first end pivotally supporting at least one end of the single cylindrical charge roller and the first arm extending generally transverse to a longitudinal axis of the single cylindrical charge roller;

a discrete stepper rotational actuator operably coupled to the first arm, wherein the stepper rotational actuator is configured to control, via discrete movements of the first arm, an elevation of the single cylindrical charge roller relative to a seam region of an outer surface of a photoconductor;

a cam directly coupled to, and rotationally driven by, the stepper rotational actuator and configured to rotate in partial revolutions along an operative region of the cam, the operative region including a variable radius contour; and a cam follower slidably movable in a cyclical manner back and forth along the operative region of the cam and linked to the second end of the first arm, wherein each cycle of movement of the cam follower corresponds to one complete revolution of the photoconductor, wherein when the cam follower tracks the variable radius contour of the operative region of the cam, the assembly causes the single cylindrical charge roller to be spaced in close proximity to the seam region of the outer surface of the photoconductor while still maintaining a charge on the outer surface of the photoconductor in the seam region.

7. The charge roller assembly of claim 6, wherein the charge roller assembly operates without the use of a seam-position sensor.

8. A method of positioning a charge roller, the method comprising:

permitting a single charge roller to rollingly engage and charge a non-seam region of an outer surface of a photoconductor; and maintaining a minimum spacing, via a discrete step actuator operably coupled to the single charge roller and without reference to a seam-position sensor, between the single charge roller and a seam region of the outer surface of the photoconductor when the seam region passes underneath the single charge roller while the single charge roller charges the seam region of the outer surface of the photoconductor.

9. The method of claim 8, wherein maintaining the minimum spacing comprises:

providing the discrete step actuator as a stepper rotational actuator; and coupling the stepper rotational actuator to the single charge roller via a linkage, wherein the stepper rotational actuator is configured to cause partial rotation of a cam of the linkage and a cam follower cyclically tracks a variable radius contour portion of the cam during the partial rotation of the cam such that the position of the cam relative to the cam follower determines a position of the single charge roller relative to the seam region of the photoconductor, wherein the variable radius contour includes a first radius region permitting the single charge roller to rolling engage the non-seam region of the photoconductor and a second radius region that prevents the single charge roller from contacting the seam region of the photoconductor, and wherein each complete cycle of tracking motion of the cam follower relative to the variable radius contour portion of the cam during the partial rotation of the cam corresponds to one complete revolution of the photoconductor.

* * * * *